US005813721A

United States Patent [19]

Arcidiacono

[11] Patent Number: 5,813,721

[45] Date of Patent: Sep. 29, 1998

[54] PORTABLE COLLAPSIBLE CHAIR

[76] Inventor: Augustine D. Arcidiacono, 8838 La Jolla Scenic Dr., La Jolla, Calif. 92037

[21] Appl. No.: 885,890

[22] Filed: Jun. 30, 1997

[51] Int. Cl.[6] ..... A47C 4/00

[52] U.S. Cl. ..... 297/16.1; 297/57; 297/31

[58] Field of Search ..... 297/440.19, 440.15, 297/447.2, 57, 56, 31, 16.1

[56] References Cited

U.S. PATENT DOCUMENTS

| | | | |
|---|---|---|---|
| 1,949,951 | 3/1934 | Bozarth | 297/31 |
| 2,490,884 | 12/1949 | Rau | 297/31 |
| 2,873,793 | 2/1959 | Garcia | 297/57 |
| 2,914,117 | 11/1959 | Underwood | 297/31 X |
| 3,485,526 | 12/1969 | Olitzky | 297/31 |
| 4,077,668 | 3/1978 | Puccinelli | 297/443 |

*Primary Examiner*—Peter M. Cuomo
*Assistant Examiner*—Stephen Vu
*Attorney, Agent, or Firm*—Frank D. Gilliam; John R. Duncan

[57] ABSTRACT

A two piece portable chair movable between a use and a storage position. A seat member has two elongated side members with a number of slats fastened transversely across the side members. A back has two elongated side members with a flexible back supporting sheet across the side members, two cross pieces at the ends and two spaced support members extending transversely between the side members. The seat can be inserted between the support members for use as a chair. The seat can also be inserted lengthwise between the back side members and wedged in place to provide a compact package for transport and storage. Tapered ends on the seat side members wedge between the support members to hold the seat in place. One of the cross pieces provides a convenient carrying handle. Movable brackets may be provided, pivotable on a rod extending between the seat side members or between the back side members to allow the angle between seat and back to be varied.

16 Claims, 2 Drawing Sheets

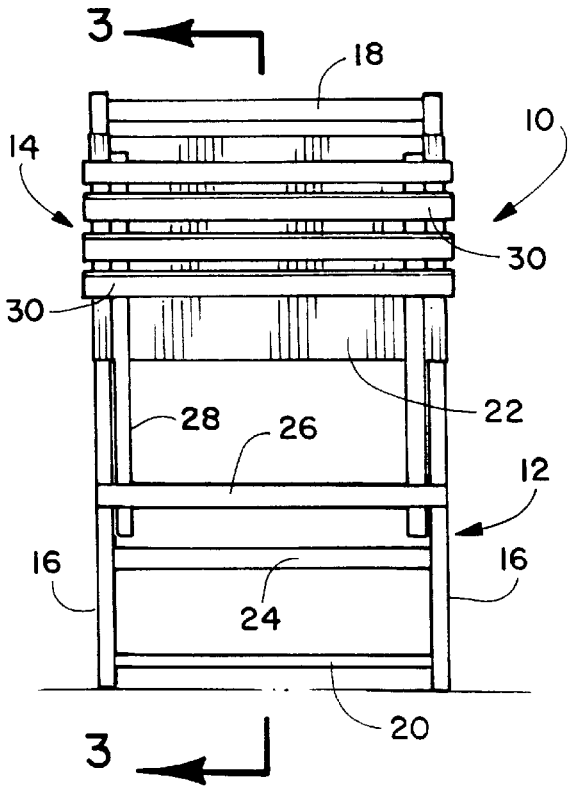
FIGURE 4
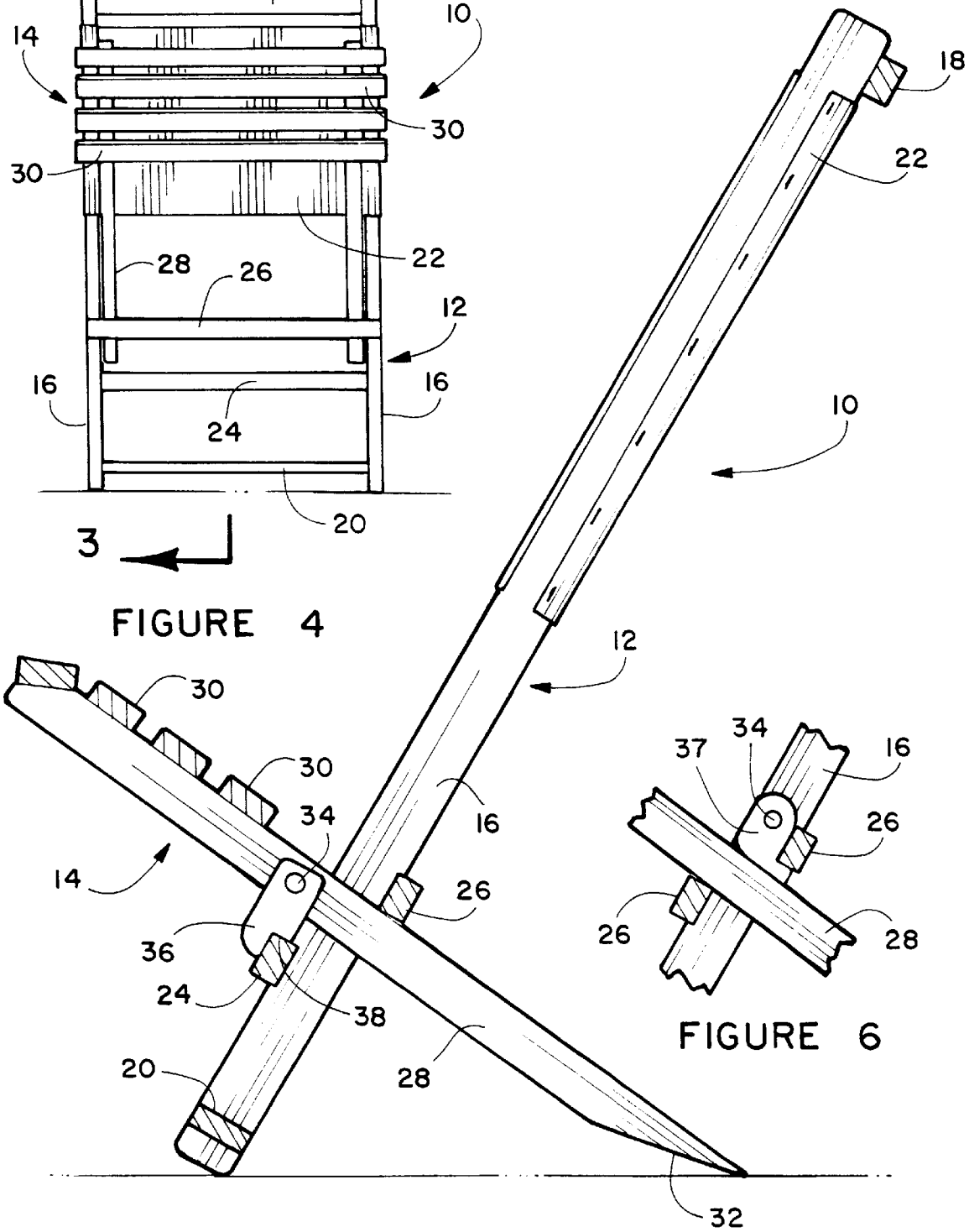
FIGURE 6
FIGURE 5

PORTABLE COLLAPSIBLE CHAIR

FIELD OF THE INVENTION

This invention relates to chairs that can be moved between a compact storage position and an opened, assembled, position for use.

BACKGROUND OF THE INVENTION

A wide variety of folding or collapsible chairs have been developed. These include metal or plastic folding chairs for use in halls or auditoriums and beach or yard chairs often having plastic straps across an aluminum tube frame or comprising canvas extending across wood frames. Others are made in two parts, a back portion and a seat portion that can be combined for seating and separated for storage and transport.

Such chairs should be comfortable, light in weight, sturdy and easily moved between collapsed storage and carrying position and an erected position for use.

A simple two-part chair is described by Skinner in U.S. Pat. No. 3,847,435. This chair is formed from two flat wood sheets, a back part having a central longitudinal slot in one end and a seat part having a narrow central portion to be inserted into the back slot and be wedged in place. This is a rather uncomfortable chair with the flat solid back and seat surfaces, is quite heavy and when disassembled requires transport and storage of two entirely separate pieces.

Other two-part separable chairs are described by Lewallen in U.S. Pat. No. 5,588,709, Hoeholt in U.S. Pat. No. 4,129,332 and Yarus in U.S. Pat. No. 3,752,532. Each of these describes a chair in which a solid seat member is inserted into a transverse slot in a solid back and wedged in place. Again, these solid back and seat elements would be uncomfortable, heavy and when disassembled would become two separate pieces that are cumbersome to transport and could become separated and misplaced in storage.

Puccinelli describes a two part chair in U.S. Pat. No. 4,077,668 that has a back made up of two wooden side members with a plurality of wooden slats therebetween and a similar seat with plural wooden slats between to side members. For use, the seat is inserted between spaced slats. For storage and transportation, the back and seat members are brought together. While effective as a portable chair, transverse slats are not very comfortable and the two components are not held in storage alignment, so that they are likely to separate when carried. The seat to back angle is not adjustable.

Thus, there is a continuing need for improved chairs that can be assembled and disassembled, that are comfortable, sturdy, lightweight and that can be easily assembled and, when disassembled can be brought together in a compact, easily stored and transported, package that will not accidentally come apart when carried. Ideally, the angle between seat and back should be variable for optimum comfort.

SUMMARY OF THE INVENTION

The above-noted problems, and others, are overcome in accordance with this invention by a portable chair that is basically made up of two parts, a seat member and a back member, that are fitted together to provide a comfortable chair and that can be disassembled and the seat member fitted into the back member in a manner that will keep the parts tightly together as the stored chair is carried by a handle means at one end.

The seat member basically includes two spaced sides with a plurality of slats extending between the sides near one end of the sides, with the slats extending slightly beyond the sides. The ends of the sides opposite the slats is tapered to help lock the seat and back members together for carrying and storage, as detailed below.

The back member includes two spaced sides, spaced apart a distance such that the seat member will fit between those sides. The back sides are secured together by transverse cross pieces at each end. The cross piece at the top end also serves as a convenient handle for carrying the chair in the storage position. A sheet of flexible material, such as canvas, extends across the two sides near the top end, to act as a flexible back support for a person seated in the chair. This sheet can have a decorative pattern, could have the owner's name silk screened or embroidered or could bear an advertisement where the chair is give away or discounted as part of an advertising program.

Two spaced supports are provided for supporting the seat member when in the chair configuration. A first support member extends across the front surface of the back at a selected position between the lower end of the back member and the sheet of flexible material. A second support is secured to the back surface of the back member, lower on the back so that a space is provided between the two supports for receiving the seat member.

To assemble the chair, the back member is held with the flexible sheet end uppermost. The tapered ends of the seat sides are inserted between the supports on the back member until the closest slat contacts the back member. The chair is placed on the ground with the slats providing a convenient chair seat and the flexible back a comfortable chair back, with the seat and back at a predetermined comfortable angle.

The chair is moved to the carrying and storage position by first withdrawing the seat member from between the back member supports. The tapered ends are then inserted between the supports along a plane essentially between the back sides. The seat slats are on the side away from the back, so the seat sides fit smoothly between the back sides and against the flexible material. The tapered seat member ends wedge between the back supports to hole the seat member in place. The back member cross piece can now be used as a handle to carry the chair without any chance of the two components separating.

When the chair is again to be setup, the seat member is withdrawn from between the back member sides and the setup sequence described above is repeated.

In an alternative embodiment, the angle between the seat and the back can be varied by selectively moving a bracket into place between a support member and the seat sides. The bracket may be pivoted about a rod mounted either on the seat side members or the back side members.

BRIEF DESCRIPTION OF THE DRAWING

Details of the invention, and of preferred embodiments thereof, will be further understood upon reference to the drawing, wherein:

FIG. 4 is a front elevation view of the chair in the storage mode;

FIG. 5 is a side section view, taken along a line generally corresponding to line 2—2 in FIG. 1, of a second embodiment of the chair of this invention having seat-to-back angle varying means; and FIG. 6 is a detail side elevation view of a second version of the seat-to-back angle varying means of the FIG. 5 embodiment.

DETAILED DESCRIPTION OF PREFERRED EMBODIMENTS

Figure 1:
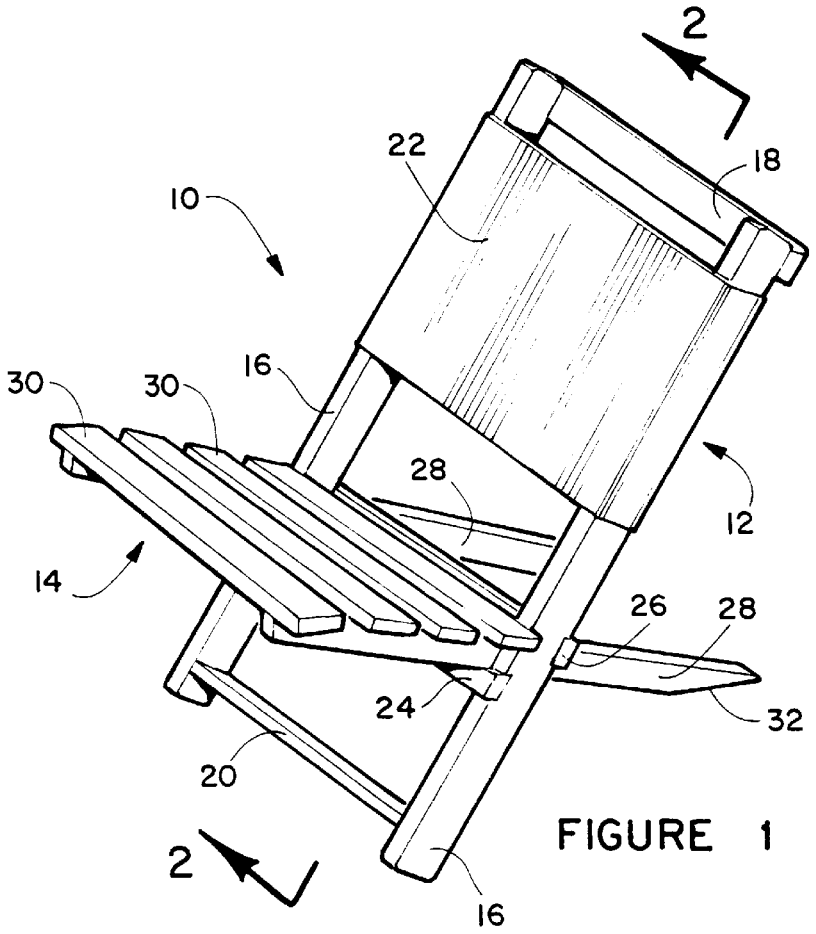
FIG. 1 is a perspective view of a first embodiment of the portable chair of this invention setup for use.
Figure 2:
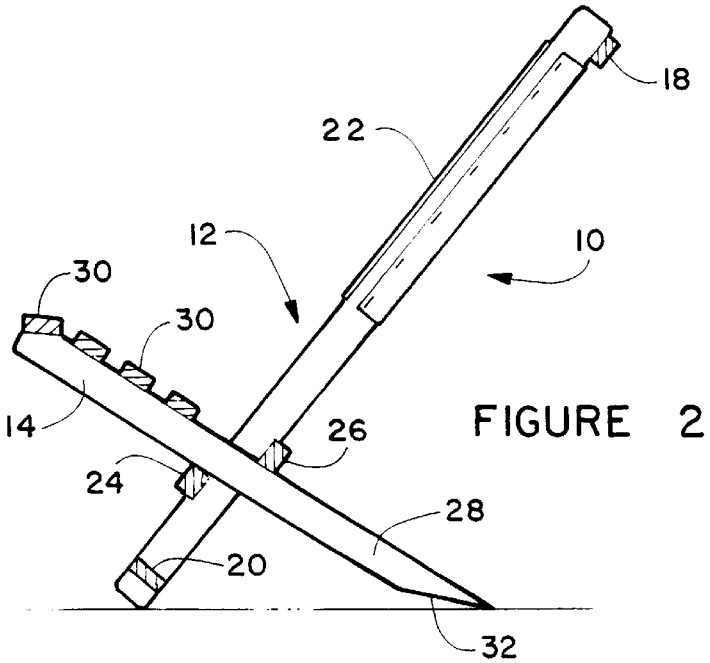
FIG. 2 is a section view taken on line 2—2 in FIG. 1.

Referring to FIGS. 1 and 2, the chair 10 of this invention is seen in the fully assembled, ready for use, position. Chair 10 is made up of two parts, a back member 12 and a seat member 14. While chair 10 could be made from any suitable material such as wood, plastic, metal, etc., wood is preferred for the optimum combination of strength, light weight and attractive appearance.

Back member 12 includes two spaced, preferably generally parallel side members 16, secured together by a first cross piece 18 at the distal end of back member 12 and a second cross piece 20 at the proximal end of back member 12. These cross pieces could be along a side of the back side members or directly between them. For optimum strength and convenience, first cross piece 18 is secured to the backside of side members 16 for convenience when that cross piece is used as a handle when carrying the chair in the storage and transport position, as detailed below. Second cross piece 20 preferably extends between side members 16 just inside their proximal ends for optimum strength.

A sheet 22 of flexible material, such as plastic or canvas, extends across the front side of side members 16 to provide a back support for a person seated in chair 10. This flexible material is much more comfortable than wooden or plastic slats across the back and is much lighter in weight, a significant factor when the chair is carried a distance. For maximum strength, the sheet 22 is wrapped around side members 16 and secured on the inside of side members 16 in any suitable manner, such as with staples.

A first support member 24 extends across the back of side members 16 and a second support member 26 extends across the front of side members 16. Support members 24 and 26 are spaced a predetermined distance apart to provide the desired angle between back 12 and seat 14. Generally, a seat-to-back angle of about 90° to 120° is preferred. In order to properly cooperate with the tapered ends of seat side members 28 in the storage position, to best secure seat 14 in the storage position, and for maximum strength the support members are recessed into the side members.

Seat 14 consists of two spaced, generally parallel, seat side members 28, which are space apart a distance such that they will slidingly fit between back side members 16. The distal ends of side members 28 have a tapered end 32 on the lower surface. This taper 32 provides the dual functions of stable contact with the ground or other surface upon which the chair is positioned and to serve to lock the seat in the storage position, as described below.

A plurality of slats 30 are secured across the upper surface of seat side members 28. Slats 30 extend slightly beyond side members 28 to aid in securing chair 10 in the storage position, as detailed below. Preferably this extension is about equal to the thickness of the back side members 16 so that the extensions will provide a smooth overlap without projecting beyond the package in the storage position. Preferably, seat side members 28 are tapered or rounded slightly at the proximal ends so that the endmost slat 30 will be slightly angled to the other slats for greater comfort of persons using the chair. The slat furthest from the proximal end of the seat side members is secured at a predetermined position such that it will engage back side members 16 when seat 14 is fully inserted.

Figure 3:
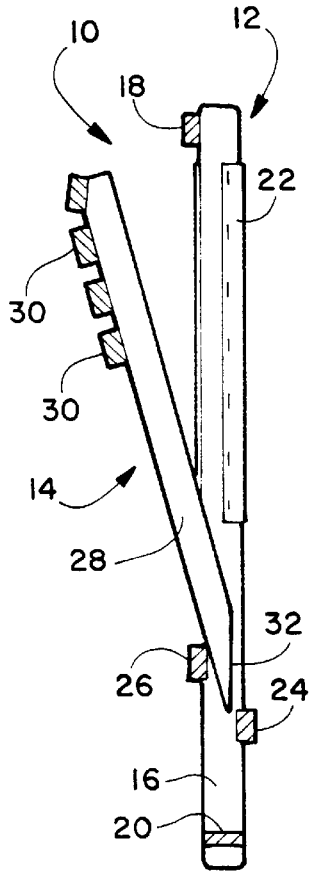
FIG. 3 is a section view taken on line 3—3 in FIG. 4, showing the chair nearly in the carrying and storage mode.

The storage position of chair 10 is illustrated in FIGS. 3 and 4. As seen in FIG. 3, seat 14 can be inserted between side members 16 of back 12 from the back, with tapered ends 32 of seat side members 28 entering between support members 24 and 26. The width of the main portion of seat side members 28 is greater than the space between recessed support members 24 and 26, so that tapered ends 32 will wedge into place as the seat is inserted and rotated until seat side members 28 are aligned with back side members 16. Preferably, the width of back side members 16 and side seat members 28 should be greater than the distance between inner edges of recessed supports 24 and 26 so as to wedge the taper 32 between them and prevent the seat from falling through the space between those supports, as is the case with other chairs, such as that described in the Puccinelli patent discussed above.

Seat 14 will be adjacent to the inner surface of sheet 22 on one side and slats 30 will abut back side members 16 on the other, making a very compact, well secured together, package for carrying and storage. Cross piece 18 provides a convenient handle for carrying chair 10. FIG. 4 shows the chair fully in the carrying and storage position.

Back 12 may have any suitable height, so long as seat 14 will clear cross piece 18. If desired, a high backed chair may have longer back side pieces 16 and a longer back supporting sheet 22. The remainder of the chair can be unchanged. The overall size of the chair can be varied, in proportion, to fit children or adults.

An alternate embodiment of chair 10, with an adjustable angle between seat 14 and back 12, is illustrated in FIG. 5. A rod 34 extends transversely through both seat side members 28. Two brackets 36 are provided on rod 34, one adjacent to the inner side of each seat side member 28. Cross pieces 24 and 26 are spaced a suitable distance so that when notch 38 in bracket 36 engages support cross piece 24, the seat to back angle will be a predetermined first angle, such as 90°. Bracket 36 can be rotated to take notch 38 out of engagement with cross piece 24, so that the seat side members 28 will directly contact cross piece 24, as in the Embodiment of FIGS. 1–4. The seat to back angle will then be a greater angle, determined by the size of bracket 36, such as about 110°. if desired, additional brackets 36 having different rod axis to notch distances, so that they could be substituted for installed brackets 36 to proved a different seat to back angle when engaged.

FIG. 6 illustrates a variation on the movable bracket assembly of FIG. 5. Here, rod 34 extends through side support members 16 with bracket 37 rotatable between a first position with notch 38 engaging second support 26 as shown and a second position with bracket 37 rotated clockwise so that notch 38 is out of contact with support 26.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A two-piece portable chair which comprises:

a seat member having top and bottom surfaces;

two spaced generally parallel seat side members each having a proximal and a distal end;

a plurality of slats extending across said seat side members adjacent to said proximal end on said top surface;

said slats extending beyond said seat side members a predetermined distance;

said seat side members being tapered at said distal end along said bottom surface; and a back member having front and back surfaces, comprising:

two spaced generally parallel back side members each having a proximal and a distal end;

said back side members being spaced apart a predetermined distance such that said seat side members can slide therebetween;

a first transverse cross piece secured to said back side member distal ends;

a second transverse cross piece secured to said back side member proximal ends;

a sheet of flexible material extending between said back side members adjacent to said distal end across said front surface;

a first support member extending between said back side members and secured to said back surface between said proximal end and said sheet;

a second support member extending between said back side members and secured to said front surface between said proximal end and said first support member;

said first and second support member being spaced apart a predetermined distance for receiving said distal end of said seat member therebetween with said seat member at a predetermined angle to said back member; and said seat member and back member having predetermined dimensions such that said distal end of said seat member can be inserted between said first and second support members along a line generally parallel to said back member and toward said back member distal end to wedge said tapered distal end between said first and second support members when said chair is in a storage position.

2. The portable chair according to claim 1 wherein at least one end of said slats extend beyond said seat side members a predetermined distance, whereby when said tapered end is in wedging engagement with said first and second support members, said seat side members will be contiguous with said flexible sheet and said extending ends will be contiguous with said back side members.

3. The portable chair according to claim 1 further including a rod extending between said seat side members;

at least two brackets rotatable on said rod and selectively engagable with said first support member;

whereby said seat member is at a different angle to said back member when said bracket engages said first support member that when said bracket is out of engagement with said first support member.

4. The portable chair according to claim 3 wherein said bracket includes a notch for selective engagement with said first support member.

5. The portable chair according to claim 1 further including a rod extending between said back side members;

at least two brackets rotatable on said rod and selectively engagable with said second support member;

whereby said seat member is at a different angle to said back member when said bracket engages said second support member that when said bracket is out of engagement with said second support member.

6. The portable chair according to claim 5 wherein said bracket includes a notch for selective engagement with said second support member.

7. The portable chair according to claim 1 wherein said flexible sheet is a woven fabric sheet wrapped at least partially around said side members and secured thereto.

8. The portable chair according to claim 1 wherein said seat side members are tapered to a narrower width on said top surface adjacent to said proximal ends so that an endmost of said slat will be angled relative to other said slats.

9. The portable chair according to claim 1 wherein said second transverse end crosspiece is secured to said back surface of said back side members adjacent to said proximal ends of said back side members for use as a carrying handle when said chair is in said storage configuration.

10. A two-piece portable chair movable between seating and storage positions; which comprises:

a seat member having top and bottom surfaces;

two spaced generally parallel seat side members each having a proximal and a distal end;

a plurality of spaced slats extending across said seat side members adjacent to said proximal end on said top surface;

said slats extending beyond said seat side members a predetermined distance;

said seat side members being tapered at said distal end along said bottom surface; and a back member having front and back surfaces, comprising:

two spaced generally parallel back side members each having a proximal end and a distal end;

said back side members being spaced apart a predetermined distance such that said seat side members can slide therebetween;

a first transverse cross piece secured to said back side member distal ends;

a second transverse cross piece secured to said back side member proximal ends on said back surface;

a sheet of flexible fabric material extending across said front surface between and secured to said back side members adjacent to said distal end;

a first support member extending between said back side members and recessed into said back surface between said proximal end and said sheet;

a second support member extending between said back side members and recessed into said front surface between said proximal end and said first support member;

said first and second support member being spaced apart a predetermined distance for receiving said distal end of said seat member therebetween with said seat member at a predetermined angle to said back member in a seating configuration;

said tapered ends of said seat side members being engagable with said support members with said seat side members within and generally parallel to said back side members in a storage configuration; and at least one end of said slats extend beyond said seat side members a predetermined distance, whereby when said tapered end is in engagement with said first and second support members, said seat side members will be contiguous with said flexible sheet and said extending ends will be contiguous with said back side members.

11. The portable chair according to claim 10 further including a rod extending between said seat side members;

at least two brackets rotatable on said rod and selectively engagable with said first support member;

whereby said seat member is at a different angle to said back member when said bracket engages said first support member that when said bracket is out of engagement with said first support member.

12. The portable chair according to claim 11 wherein said bracket includes a notch for selective engagement with said first support member.

13. The portable chair according to claim 10 further including a rod extending between said back side members;

at least two brackets rotatable on said rod and selectively engagable with said second support member;

whereby said seat member is at a different angle to said back member when said bracket engages said second support member that when said bracket is out of engagement with said second support member.

14. The portable chair according to claim 13 wherein said bracket includes a notch for selective engagement with said second support member.

15. The portable chair according to claim 10 wherein said seat side members are tapered to a narrower width on said top surface adjacent to said proximal ends so that an endmost of said slat will be angled relative to other said slats.

16. A two-piece portable chair which comprises:

a seat member having top and bottom surfaces;

two spaced generally parallel seat side members each having a proximal and a distal end;

a plurality of slats extending across said seat side members adjacent to said proximal end on said top surface;

said slats extending beyond said seat side members a predetermined distance;

said seat side members being tapered to a narrower width on said top surface adjacent to said proximal ends so that an endmost said slat will be angled relative to other slats;

said seat side members being tapered at said distal end along said bottom surface; and a back member having front and back surfaces, comprising:

two spaced generally parallel back side members each having a proximal and a distal end;

said back side members being spaced apart a predetermined distance such that said seat side members can slide therebetween;

a first transverse cross piece secured to said back side member distal ends;

a second transverse cross piece secured to said back side member proximal ends;

a sheet of flexible material extending between said back side members adjacent to said distal end across said front surface;

a first support member extending between said back side members and secured to said back surface between said proximal end and said sheet;

a second support member extending between said back side members and secured to said front surface between said proximal end and said first support member;

said first and second support member being spaced apart a predetermined distance for receiving said distal end of said seat member therebetween with said seat member at a predetermined angle to said back member.

* * * * *